US010998667B2

(12) United States Patent
Yang et al.

(10) Patent No.: US 10,998,667 B2
(45) Date of Patent: May 4, 2021

(54) ROTATABLE ELECTRIC PLUG

(71) Applicant: Shenzhen Chenbei Technology Co., Ltd., Shenzhen (CN)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 0 days.

(21) Appl. No.: 16/714,448

(22) Filed: Dec. 13, 2019

(65) Prior Publication Data

US 2020/0194924 A1 Jun. 18, 2020

(30) Foreign Application Priority Data

Dec. 13, 2018 (CN) ..... 201811527053.3

(51) Int. Cl.

| | |
|---|---|
| ***H01R 13/514*** | (2006.01) |
| ***H01R 31/06*** | (2006.01) |
| ***H01R 13/11*** | (2006.01) |
| ***H01R 35/04*** | (2006.01) |
| *H01R 105/00* | (2006.01) |

(52) U.S. Cl.

CPC ..... *H01R 13/514* (2013.01); *H01R 13/111* (2013.01); *H01R 31/06* (2013.01); *H01R 35/04* (2013.01); *H01R 2105/00* (2013.01)

(58) Field of Classification Search

CPC .... H01R 13/514; H01R 31/06; H01R 13/111; H01R 35/04; H01R 2105/00; H01R 24/70

USPC ..... 439/660, 10, 11, 13, 20, 22, 164, 171, 439/177, 310

See application file for complete search history.

(56) References Cited

U.S. PATENT DOCUMENTS

| | | | | |
|---|---|---|---|---|
| 4,533,796 A * | 8/1985 | Engelmore | H01R 39/643 379/438 |
| 5,595,503 A * | 1/1997 | Pittman | H01R 13/56 439/11 |
| 6,821,134 B2 * | 11/2004 | Chen | H01R 35/04 439/11 |
| 7,168,969 B1 * | 1/2007 | Wang | H01R 13/213 439/173 |
| 7,665,997 B1 * | 2/2010 | Lin | H01R 27/00 439/22 |
| 7,874,853 B2 * | 1/2011 | Chiang | H01R 13/6675 439/173 |
| 8,821,171 B2 * | 9/2014 | Belongia | H01R 35/04 439/166 |
| 8,858,236 B2 * | 10/2014 | Richard | H01R 24/68 439/21 |

(Continued)

*Primary Examiner* — Travis S Chambers

(74) *Attorney, Agent, or Firm* — Tsz Lung Yeung

(57) ABSTRACT

A rotatable electric plug includes a plug housing including a sleeve body, a plug module including a mounting body and at least a protruding pin, and a limiting assembly coupled to the sleeve body and the mounting body. The mounting body is rotatably coupled in the sleeve body that a rotational movement of the mounting body is reversible. The mounting body has a first side and an opposed second side that a portion of the protruding pin is extended from the first side of the mounting body. The limiting assembly is arranged to block the plug module from rotating infinitely at the plug housing in one direction. The rotatable electric plug has the advantages of enabling the reversibly rotational movement of the plug module, enhancing the rotational movement of the plug module, retaining the plug module at an angular angle, and preventing the plug module from being infinitely rotated.

2 Claims, 9 Drawing Sheets

(56) References Cited

U.S. PATENT DOCUMENTS

| | | | | |
|---|---|---|---|---|
| 9,419,397 | B2 * | 8/2016 | Wu | H01R 35/04 |
| 2009/0280665 | A1 * | 11/2009 | Yang | H01R 24/68 439/173 |
| 2010/0120278 | A1 * | 5/2010 | Yang | H01R 35/04 439/171 |
| 2013/0078867 | A1 * | 3/2013 | Chongyu | H01R 35/04 439/660 |
| 2019/0123487 | A1 * | 4/2019 | Norland | H01R 13/622 |

* cited by examiner

ROTATABLE ELECTRIC PLUG

BACKGROUND OF THE PRESENT INVENTION

Field of Invention

The present invention relates to an electric connector, and more particularly to a rotatable electric plug.

Description of Related Arts

An electric plug is a connector attached to an electrical appliance for detachably connecting to an electrical socket for acquiring electrical connection. A conventional electric plug generally comprises a plurality of protruding pins to form a male connector for matching with pin openings of the electrical socket as a female connector. For safety purposes, many domestic wall sockets provide a unidirectional plug-in feature that the electric plug can only be plugged into the wall socket at a particular orientation or direction. In order to solve the above problem, improved electric sockets have been provided in which electric sockets may be rotated to match with the plug-in direction of the electric plug. However, the structural configuration of the rotatable electric socket is usually complicated, the cost thereof is relatively high, and the manufacturing process is often complicated and time-consuming. Furthermore, the service life span of conventional rotatable electric sockets is relatively short due to the presence of rotational movement.

As a result, there is a need to develop a rotatable electric plug which may resolve the above-mentioned problems.

SUMMARY OF THE PRESENT INVENTION

Certain variations of the present invention provide a rotatable electric plug which comprises a plug module rotatably coupled at a plug housing to selective adjust an orientation of the protruding pins.

Certain variations of the present invention provide a rotatable electric plug, wherein the plug module can be smoothly rotated at the plug housing and can be held at a desired angle.

Certain variations of the present invention provide a rotatable electric plug, wherein the rotatable movement of the plug module at the plug housing is blocked by a limiting assembly to prevent the plug module from being infinitely rotated within the plug housing.

Certain variations of the present invention provide a rotatable electric plug, wherein the structural configuration among the plug housing, the plug module and the limiting assembly is simple to enhance the manufacturing process of the present invention.

Certain variations of the present invention provide an air purifying prompting system which is easy to operate while being cost effective.

In one aspect of the present invention, it provides a rotatable electric plug, comprising:

a plug housing which comprises a sleeve body having a hollow structure;

a plug module which comprises a mounting body rotatably coupled in said sleeve body that a rotatable movement of said mounting body is reversible, and at least a protruding pin extended from said mounting body, wherein said mounting body has a first side and an opposed second side that a portion of said protruding pin is extended from said first side of said mounting body; and a limiting assembly coupled to said sleeve body and said mounting body to block said plug module from rotating infinitely at said plug housing in one direction.

This summary presented above is provided merely to introduce certain concepts and not to identify any key or essential features of the claimed subject matter.

DETAILED DESCRIPTION OF THE PREFERRED EMBODIMENT

Figure 1:
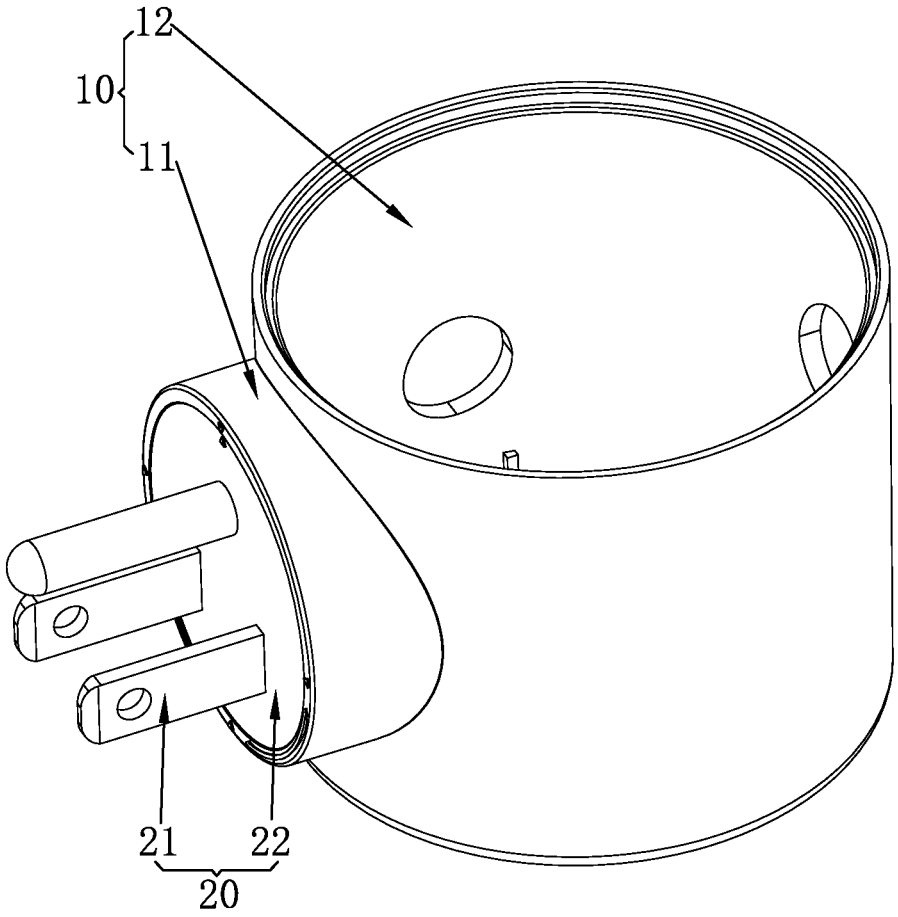
FIG. 1 is a perspective view of a rotatable electric plug according to a preferred embodiment of the present invention.

The following detailed description of the preferred embodiment is the preferred mode of carrying out the invention. The description is not to be taken in any limiting sense. It is presented for the purpose of illustrating the general principles of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Therefore, the above terms should not be an actual connection limitation of the elements of the present invention.

Referring to FIG. 1 to FIG. 9 of the drawings, a rotatable electric plug according to a preferred embodiment of the present invention is illustrated. Broadly, the rotatable electric plug may comprise a plug housing 10, a plug module 20, and a limiting assembly 30.

The plug module 20 may be rotatably disposed at the plug housing 10 and comprise two or more connecting pins 21 for inserting into pin openings of an electric socket 40 respectively. The limiting assembly 30 may be connected between the plug housing 10 and the plug module 20 for preventing the plug module 20 from rotating in an infinite direction.

It is worth mentioning that by configuring the rotatable movement between the plug housing 10 and the plug module 20, and by connecting the limiting assembly 30 between the plug housing 10 and the plug module 20, the rotatable electric plug of the present invention may be formed to achieve the features of mutual rotation between the plug housing 10 and the plug module 20 and restricted rotation between the plug housing 10 and the plug module 20 at a limited angular displacement so as to enhance the practical use of the rotatable electric plug. In addition, the rotatable movement of the plug module 20 may be configured to be reversible, wherein the plug module 20 may be able to rotate in a first direction, such as a clockwise direction, and in an opposed second direction, such as a counterclockwise direction.

Through the connection configurations among the plug housing 10, the plug module 20 and the limiting assembly 30, a plug-in direction of the rotatable electric plug may be rotatably adjusted. When the electrical socket 40, such as an external socket or a wall socket, is fixed at a predetermined location with a limited plugging direction for the electric plug, the plug module 20 may be selectively rotated with respect to the plug housing 10 to adjust the plug-in direction for matching with the plugging direction of the electric socket 40, so as to enable the rotatable electric plug of the present invention connected to the electric socket.

Figure 2:
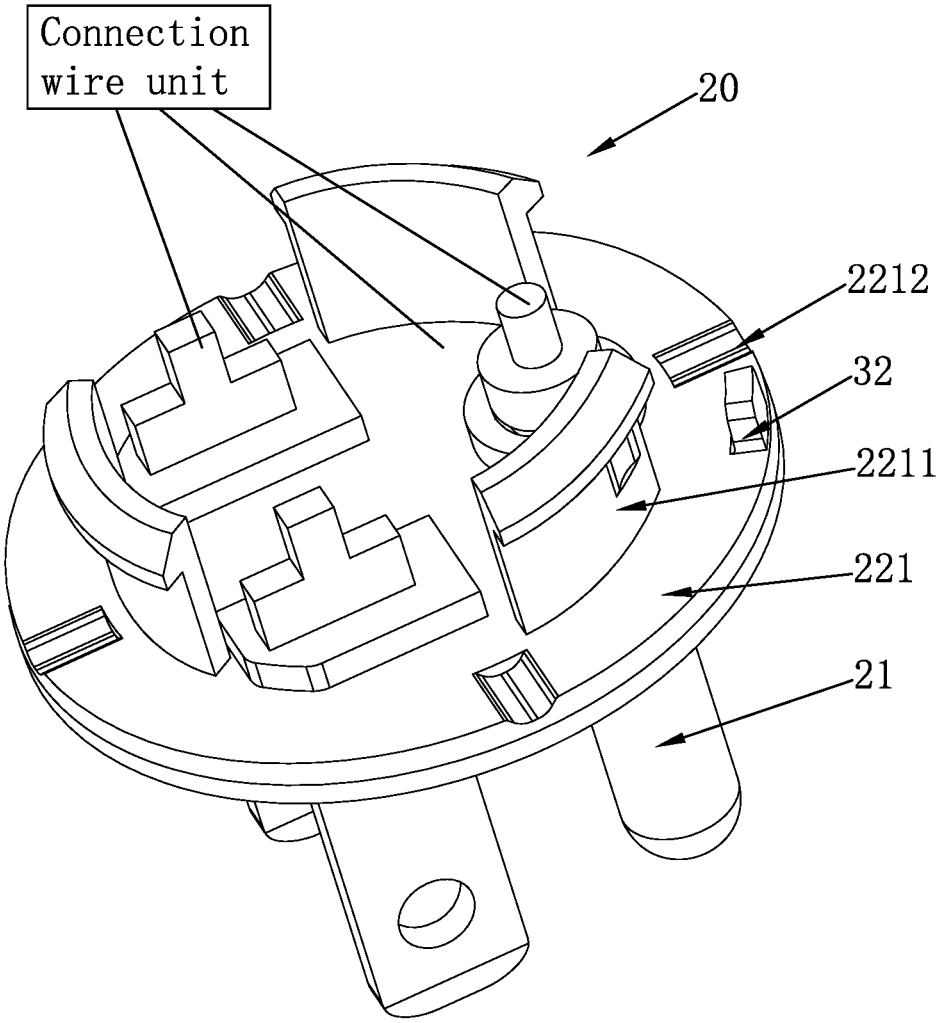
FIG. 2 is a perspective view of a plug module of the rotatable electric plug according to the preferred embodiment of the present invention.

As shown in FIG. 2 of the drawings, the protruding pins 21 may be provided at the plug module 20 for connecting to the electric socket 40. The number of protruding pins 21 may be 2 or 3. The number of protruding pins 21 may be varied depending on the circumstances in which the present invention is actually use. During the manufacturing process of the rotatable electric plug of the present invention, the orientation of the protruding pins 21 and the number of protruding pins 21 may be selectively adjusted according to the pin opening of the electric socket 40. Since the plug module 20 may be rotatable with respect to the plug housing 10, the orientation of the protruding pins 21 may be adjusted to retain the protruding pints 21 at a desired angle, such that the protruding pins 21 may be plugged into the electric socket 40.

Figure 3:
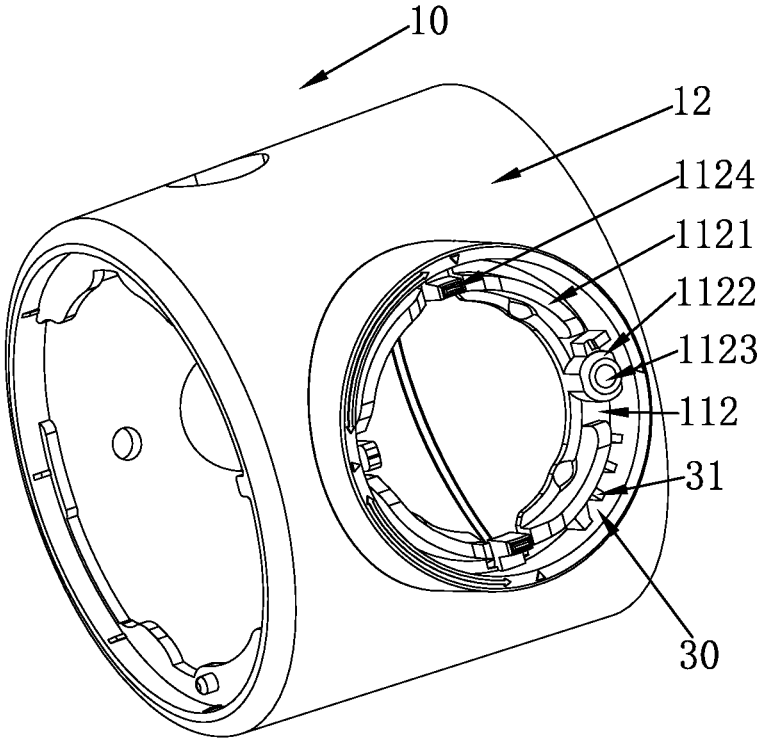
FIG. 3 is a perspective view of a plug housing of the rotatable electric plug according to the preferred embodiment of the present invention.

As shown in FIG. 2 to FIG. 3 of the drawings, the limiting assembly 30 may be connected to the plug housing 10 and the plug module 20. When the plug module 20 is rotated at the plug housing 10 in one direction to reach at a certain angular angle, the limiting assembly 30 may restrict the further rotatable movement of the plug module 20 so as to limit the angular displacement of the plug module 20. At this position, the plug module 20 may only be rotated at the plug housing 10 in the opposed direction. Therefore, the limiting assembly 30 may be configured to prevent the plug module 20 from rotating infinitely at the plug housing 10 in one direction, so as to restrict the relative rotation of the plug module 20 to the plug housing 10 with a limited angular route of the plug module 20. Specifically, the protruding pins 21 may extend from the plug module 20 and may be electrically connected to a connection line unit, such as a power line or a data line, extended from the plug housing 10. Since the limiting assembly 30 may be arranged to restrict the rotatable movement of the plug module 20, the protruding pins 21 and the connection line unit may remain connected. In other words, the connection line unit will not be damaged due to the rotatable movement of the plug module 20 with respect to the plug housing 10.

As shown in FIG. 2 to FIG. 3 of the drawings, the plug housing 10 may comprise an extension casing 11 and a main casing 12, wherein the extension casing 11 may extend from one side of the main casing 12. Preferably, the main casing 12 may have a tubular shape, wherein the extension casing 11 may perpendicularly extend from a surrounding wall of the main casing 12. The plug module 20 may further comprise a mounting body 22, wherein the protruding pins 21 may spacedly protrude from a mid-portion of the mounting body 22. Accordingly, the mounting body 22 of the plug module 20 may be rotatably coupled in the extension casing 11 of the plug module 20, such that the orientation of the protruding pins 21 may be selectively adjusted by rotating the mounting body 22 in the extension casing 11. In this preferred embodiment, the extension casing 11 may have a cylindrical shape and the mounting body 22 may have a circular disc shape, wherein the mounting body 22 may coaxially align within the extension casing 11 to allow the protruding pins 21 being rotated with respect to the plug housing 10.

Specifically, the plug module 20 may be connected to the connection line unit, wherein the connection line unit may comprise three conductive wires, i.e. a live wire, a ground wire and a neutral wire. The conductive wires may be directly and electrically connected to the protruding pins 21 respectively, such that the connection line unit may be electrically connected to a power source when the protruding pins 21 are connected to the electric socket 40. The main casing 12 may have a cylindrically shaped body, and the shape thereof should not be limited. Accordingly, the plug housing 10 may be made of or configured from insulated material.

Figure 5:
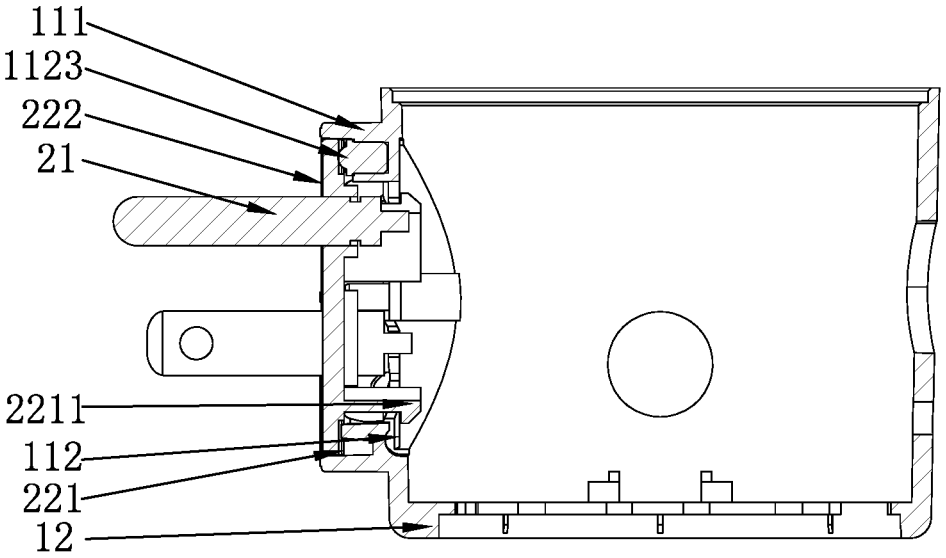
FIG. 5 is a sectional view of the rotatable electric plug according to the preferred embodiment of the present invention.

As shown in FIG. 3 and FIG. 5 of the drawings, the extension casing 11 may comprise a sleeve body 111 and a blocking rim 112, wherein the blocking rim 112 may radially extend from an inner wall of the sleeve body 111. Preferably, the blocking rim 112 may integrally and inwardly extend from the sleeve body 111, such that the blocking rim 112 may extend within the sleeve body 111. The mounting body 22 of the plug module 20 may be rotatably coupled within the sleeve body 111.

The sleeve body 111 may have a cylindrical shape and the mounting body 22 may have a disc shape matching with the size of the sleeve body 111. Therefore, the mounting body 22 may be coaxially mounted in the sleeve body 111 to rotate within the inner wall of the sleeve body 111 and may be blocked by the blocking rim 112. During the rotational movement of the mounting body 22 in the sleeve body 111, the blocking rim 112 may be arranged to ensure the mounting body 22 being rotated in the sleeve body 111 but not further slid into the sleeve body 111. It is worth mentioning that the blocking rim 112 may be formed at the mounting body 22 so as to ensure the rotational movement of the mounting body 22 with respect to the plug housing 10. In addition, the mounting body 22 may be engaged with the blocking rim 112 to prevent the mounting body 22 from detaching from the sleeve body 111 while the mounting body 22 may be rotatably coupled at the sleeve body 111.

Figure 4:
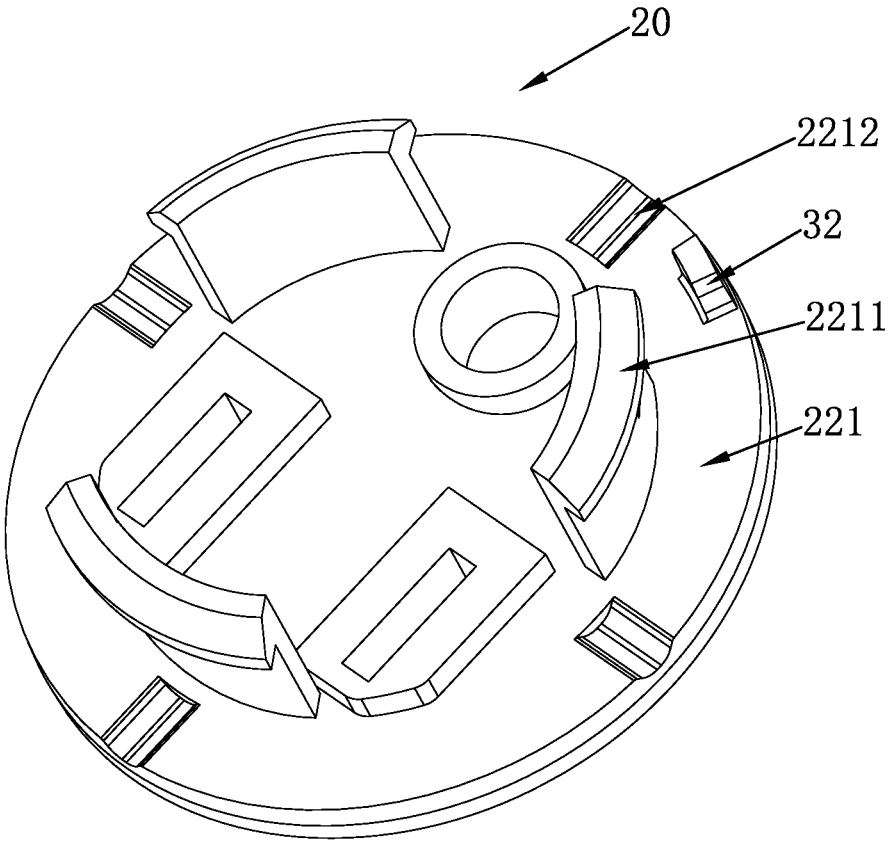
FIG. 4 is a perspective view of a mounting body of the plug module of the rotatable electric plug according to the preferred embodiment of the present invention.

As shown in FIG. 3 and FIG. 4 of the drawings, the mounting body 22 may have a first side 221 and a second side 222 opposite to the first side 221, wherein the protruding pins 21 may extend through the first side 221 and the second side 222 and may be affixed at the mounting body 22, wherein a portion of each of the protruding pins 21 extended from the second side 222 of the mounting body 22 may be arranged to detachably insert into the pin opening of the electric socket 40 and a portion of each of the protruding pins 21 extended from the first side 221 of the mounting body 22 may be arranged to connect with the connection wire unit. When the protruding pins 21 are inserted into the pin openings of the electric socket 40 to couple the plug module 20 at the electric socket 40, the second side 222 of the mounting body 22 may contact with an outer surface of the electric socket 40 while the first side 221 of the mounting body 22 may face toward the blocking rim 112. Thus, the mounting body 22 may be mounted at the extension casing 11 at a position that the first side 221 may face toward the blocking rim 112.

As shown in FIG. 4 of the drawings, the mounting body 22 may further comprise one or more coupling members 2211 formed at the first side 221 of the mounting body 22 to engage with the extension casing 11 so as to enable the rotational movement of the mounting body 22 within the extension casing 11. When two or more coupling members 2211 are required, the coupling members 2211 may be evenly distributed on the first side 221 of the mounting body 22 to face toward the extension casing 11. The coupling members 2211 may also face toward the blocking rim 112 when the mounting body 22 is mounted at the extension casing 11.

In addition, the coupling member 2211 may have a latch structure to define a latch free end for engagement. Accordingly, the extension casing 11 may have a hollow structure to define a center through hole. The coupling members 2211 may extend through the center through hole of the extension casing 11 in order to locate within an interior of the extension casing 11. Therefore, the coupling members 2211 may be coupled, preferably by snap connection, at a back side of the blocking rim 112 which faces away from the mounting body 22. Thus, each of the coupling members 2211 may have a slightly flexible ability able to pass a front side of the blocking rim 112 to engage with the back side thereof by the latch free end of the coupling member 2211. Once the mounting body 22 is coupled at the extension casing 11, the coupling members 2211 may be coupled at the blocking rim 112 to prevent the mounting body 22 being detached from the extension casing 11 and to enable latch free end of the coupling member 2211 being slid at the back side of the blocking rim 112 so as to enable the plug module 20 being rotated at the plug housing 10. In this preferred embodiment of the present invention, three coupling members 2211 may protrude from the first side 221 of the mounting body 22, wherein each of the coupling members 2211 may have an arc configuration, so that the coupling members 2211 may coaxially align with the first side 221 of the mounting body 22 corresponding to an inner diameter of the blocking rim 112.

Figure 6:
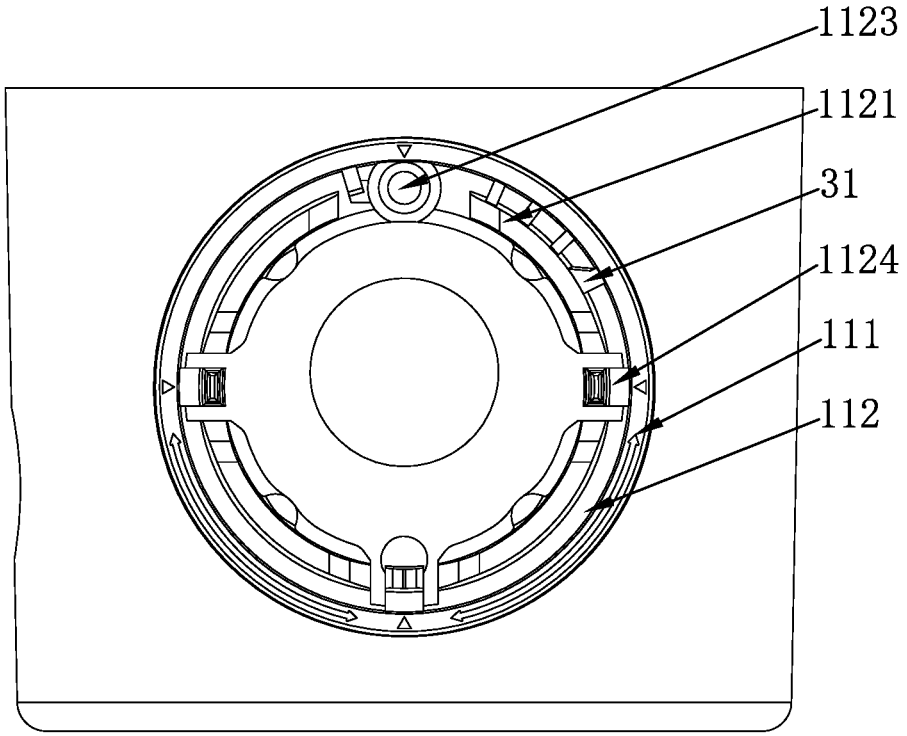
FIG. 6 is a plain view of the plug housing of the rotatable electric plug according to the preferred embodiment of the present invention.

As shown in FIG. 3 and FIG. 5 to FIG. 6 of the drawings, the plug housing 10 may further comprise a bearing unit for enhancing the rotational movement of the mounting body 22 within the extension casing 11. The bearing unit may comprise one or more guiding protrusions 1121 extended from the blocking rim 112 toward the mounting body 22. Preferably, two or more guiding protrusions 1121 may be provided to contact with the first side 221 of the mounting body 22, such that the guiding protrusions 1121 may evenly bias against the first side 221 of the mounting body 22 for ensuring the rotational movement of the mounting body 22 in a stable and balancing manner.

Each of the guiding protrusions 1121 may have an arc shape aligning with each other in an end-to-end manner, such that the guiding protrusions 1121 may be coaxially formed at the blocking rim 112. The bearing unit may further have a receiving groove 1122 having an arc shape formed at the blocking rim 112 adjacent to the guiding protrusion 1121 and may comprise a ball bearing element 1123 rotatably disposed at the receiving groove 1122 to bias against the mounting body 22, such that the mounting body 22 may be smoothly rotated within the extension casing 11. It is understood that two or more ball bearing elements 1123 may evenly be provided at the blocking rim 112 to evenly bias against the mounting body 22 in a balancing manner. However, the number of ball bearing element 1123 should not be limited. In this preferred embodiment, only one ball bearing element 1123 may be provided to enhance the rotational movement of the mounting body 22.

The mounting body 22 may further comprise at least one, but preferably two, first sliding grooves 2212 formed at a circumferential portion of the first side 221 of the mounting body 22, wherein the first sliding grooves 2212 may be radially indented on the first side 221 of the mounting body 22 at a position that the first sliding grooves 2212 is radially extended to a peripheral edge of the mounting body 22. Preferably, the four first sliding grooves 2212 may be formed at the circumferential portion of the first side 221 of the mounting body 22 corresponding to the ball bearing element 1123 respectively. When the mounting body 22 is received in the extension casing 11, the ball bearing element 1123 may be slid at one of the first sliding grooves 2212 to retain the mounting body 22 at a desired angular position. Thus, when the mounting body 22 is rotated, the ball bearing element 1132 may be slid on the first side 221 of the mounting body 22 from one first sliding groove 2212 to another first sliding groove 2212, such that the angular angle of the mounting body 22 can be retained and notified once the ball bearing element 1132 is engaged with one of the first sliding groove 2212.

Specifically, the guiding protrusions 1121 may be circumferentially disposed on one side of the blocking rim 112 near the inner wall of the sleeve body 111. The guiding protrusions 1121 may be evenly distributed at the circumferential portion of the blocking rim 112. There may be three guiding protrusions 1121 in this preferred embodiment. The contacting surfaces of the guiding protrusions 1121 may form a rotating surface facing toward the first side 221 of the mounting body 22. Correspondingly, the mounting body 22 may be rotatably coupled at the sleeve body 111 and may be stopped by the blocking rim 112, wherein the first side 221 of the mounting body 22 may be rotated at the rotating surface.

As shown in FIG. 4 to FIG. 5 of the drawings, the first side 221 of the mounting body 22 may be rotated at the extension casing 11 at a position that the ball bearing element 1123 is disposed between the blocking rim 112 and the first side 221 of the mounting body 22. Therefore, the mounting body 22 may be guided to slide on the ball bearing element 1123 at the first side 221, such that the circumferential portion of the first side 221 of mounting body 22 may be guided by the ball bearing element 1123. The ball bearing element 1123 may reduce the friction between the first side 221 of the mounting body 22 and the guiding protrusions 1121. As a result, the rotational movement of the plug module 20 may become smoother to enhance the rotational operation of the plug module 20 at the plug housing 10.

Referring to FIG. 3, FIG. 5 to FIG. 6 of the drawings, the extension casing 11 may further comprise one or more sliding blocker 1124 provided at the blocking rim 112. In one example, the sliding blocker 1124 may be provided between every two ends of the guiding protrusions 1121. Alternatively, the sliding blocker 1124 may be provided at each of the guiding protrusions 1121. Accordingly, the sliding blockers 1124 and the guiding protrusions 1121 may be circumferentially distributed at the blocking rim 112. The height of the sliding blocker 1124 with respect to the blocking rim 112 may be the same as the height of the ball bearing element 1123 with respect to the blocking rim 112. The ball surface of the ball bearing element 1123 and the free ends of the sliding blockers 1124 may be in contact with and slide at the first side 221 of the mounting body 22 at the same time. The sliding blockers 1124, the ball bearing elements 1123 and the first sliding grooves 2212 may be correspondingly disposed.

When the first side 221 of the mounting body 22 is rotated at the extension casing 11, the guiding protrusion 1121 may be arranged to directly contact with the surface of the first side 221 of the mounting body 22 but not the first sliding groove 2212. When the ball bearing element 1123 is guided to slide until it engages with the first sliding groove 2212, the sliding blockers 1124 may be arranged to also slide at and engage with the first sliding grooves 2212 respectively. When the ball bearing element 1123 is engaged with one of the first sliding grooves 2212, the sliding blockers 1124 may engage with the rest of the first sliding grooves 2212 at the same time. When the ball bearing element 1123 is disengaged with one of the first sliding grooves 2212, the sliding blockers 1124 may disengage from the rest of the first sliding grooves 2212 at the same time.

In other words, the ball bearing element 1123 and the sliding blockers 1124 may simultaneously slide at the corresponding first sliding grooves 2212. Via the mutual rotatable connection between the mounting body 22 and the extension casing 11, the rotational movement of the mounting body 22 may be stopped by the groove structure of the first sliding groove 2212. Therefore, the ball bearing element 1123 may be arranged to reduce the friction between the first side 221 of the mounting body 22 and the guiding protrusion 1121 so as to enhance the smoothness of the rotation of the mounting body 22. The sliding blockers 1124 may be configured to contact the first sliding grooves 2212 to restrict the movement thereof so as to block the mutual rotation between the mounting body 22 and the extension casing 11. Therefore, when the plug module 20 is rotated at a desired angle, the plug module 20 may not be continuously rotated at the plug housing 10 to change the desired angle of the plug module 20. The sliding blocker 1124 may be fixed to the blocking rim 112 and may not rotate.

Note that the ball bearing element 1123 may be formed in two types. The first type of the ball bearing element 1123 may be integrally formed at the guiding protrusion 1121, wherein, similar to the sliding blocker 1124, the ball bearing element 1123 may not be rotated, such that the mounting body 22 is contacted with the ball surface of the ball bearing element 1123 for rotation. The second type of the ball bearing element 1123 may be coupled at the guiding protrusion 1121 in a rotatable manner, such that the ball bearing element 1123 may be rotated to enhance the smoothness of the rotation of the mounting body 22.

As shown in FIG. 3 of the drawings, the guiding protrusions 1121 may be uniformly and circumferentially distributed on the blocking rim 112, wherein the ball bearing element 1123 and the sliding blockers 1124 may be together uniformly and circumferentially distributed on the blocking rim 112. The ball bearing element 1123 and the sliding blockers 1124 may slide at the first sliding groove 2212 and may be uniformly distributed, such that an even contacting force between the first side 221 of the mounting body 22 and the guiding protrusions 1121, the ball bearing element 1123 and the sliding blockers 1124 may be created. As a result, the mounting body 22 may be smoothly and stably rotated at the extension casing 11 to enhance the practice use of the present invention.

As shown in FIG. 3 of the drawings, the ball bearing element 1123 and the sliding blockers 1124 may be uniformly distributed along the circumferential portion of the blocking rim 112. In the preferred embodiment, one ball bearing element 1123 and three sliding blockers 1124 may be used in the present invention. However, the number of the ball bearing element 1123 and the sliding blocker 1124 should not be limited and can be selectively configured according to the actual use of the plug housing 10. For example, two ball bearing elements 1123 and two sliding blockers 1124 can be used and are located in an alternating manner.

As shown in FIG. 3 and FIG. 6 of the drawings, the limiting assembly 30 may comprise one or more first limiting members 31. The first limiting member 31 may outwardly extend from the blocking rim 112. When two or more first limiting members 31 are provided, the first limiting members 31 may be spacedly and radially distributed at the blocking rim 112. The first limiting members 31 may serve as a plurality of limiting blocks.

It is worth mentioning that the first limiting members 31 may only be formed at an angular portion of the blocking rim 112. The first limiting member 31 may be preferably disposed between the inner wall of the sleeve body 111 of the housing 10 and the guiding protrusion 1121. However, the location of the first limiting member 31 should not be limited. The first limiting member 31 may be extend from the blocking rim 112 at an area where the guiding protrusion 1121 is not extended therefrom. In addition, the coupling member 2211 and the inner wall of the sleeve body 111 may not block each other to ensure smooth rotation between the plug module 20 and the plug housing 10. In this preferred embodiment, the first limiting member 31 may not be fixed to the inner wall of the sleeve body 111 and the guiding protrusion 112. Accordingly, the first limiting member 31 may have a first engaging portion extended circumferentially, wherein the shape of the first engaging portion may not be limited. The first limiting member 31 may further have a first blocking portion extended from the first engaging portion.

As shown in FIG. 4 of the drawings, the limiting assembly 30 may further comprise a second limiting member 32 formed at the first side 221 of the mounting body 22 and protruded toward the extension casing 11. The second limiting member 32 may be located adjacent to one of the first sliding grooves 2212 to align with the first limiting member 31. It should be understood that the second limiting member 32 may be located at different locations as long as the second limiting member 32 is aligned with the first limiting member 31. In other words, when the plug module 20 is rotated at the plug housing 10, the second limiting member 32 may contact with the first limiting member 31 to block further rotational movement of the plug module 20.

The second limiting member 32 may have a second engaging portion and a second blocking portion extended from the second engaging portion, wherein the second blocking portion of the second limiting member 32 may contact the first blocking portion of the first limiting member 31 via snap connection. When the plug module 20 is rotated at the plug housing 10 at a certain angular angle, such as rotating the plug module 20 at almost one revolution, the first limiting member 31 may contact the second limiting member 32. In other words, the plug module 20 may rotate in one direction until the first limiting member 31 and the second limiting member 32 contact with each other, so as to block the further rotational movement of the plug module 20 at the plug housing 10. Therefore, the plug module 20 may only be rotated at a limited angle and limited angular displacement and the plug module 20 may not be infinitely rotated at the plug housing 10.

On the other hand, the first limiting member 31 may have a first limiting surface defined as the first engaging portion and an opposed second limiting surface as the first blocking portion. The second limiting member 32 may have a third limiting surface defined as the second engaging portion and an opposed fourth limiting surface defined as the second blocking portion. Accordingly, when the mounting body 22 is rotated in one direction until the third limiting surface is contacted with the first limiting surface, the plug module 20 may be blocked to further rotate in one direction. When the mounting body 22 is reversibly rotated in an opposite direction until the fourth limiting surface is contacted with the second limiting surface, the plug module 20 may be blocked to further rotate in the opposite direction. The first limiting surface of the first limiting member 31 and the third limiting surface of the second limiting member 32 may be configured as two flat surfaces while the second limiting surface of the first limiting member 31 and the fourth limiting surface of the second limiting member 32 may be configured as two inclined surfaces. Therefore, the first limiting member 31 and the second limiting member 32 may form a trapezoidal shape. Note that the shape of the second limiting member 32 should not be limited as long as it may be engaged with the first limiting member 31.

The arrangement of the first limiting member 31 and the second limiting member 32 should not be interfered with the rotatable arrangement between the plug module 20 and the plug housing 10.

Since the limiting assembly 30 may be arranged to limit the angular displacement of the plug module 20 with respect to the housing 10, the limited rotational movement of the plug module 20 may prevent any damage of the connection line unit connected to the protruding pins 21. It is known that if the plug module 20 can be infinitely rotated in one direction, the connection line unit will be twisted until it is broken or disconnected with the protruding pin 21.

According to the preferred embodiment, by configuring the rotational movement between the plug module 20 and the plug housing 10 and the connection of the limiting assembly 30 to the plug housing 10 and the plug module 20, the orientation of the protruding pins 21 may be selectively adjusted to adjust the plug-in direction thereof by simply rotating the plug module 20 at the plug housing 10. At the same time, the angular displacement of the plug module 20 may be limited by the limiting assembly 30 to prevent the plug module 20 being infinitely rotated. So, the present invention is able to not only solve the conventional technical problem of difficultly matching the plugging direction of the electric socket 40 but also improve the rotational movement of the plug module 20.

Figure 7:
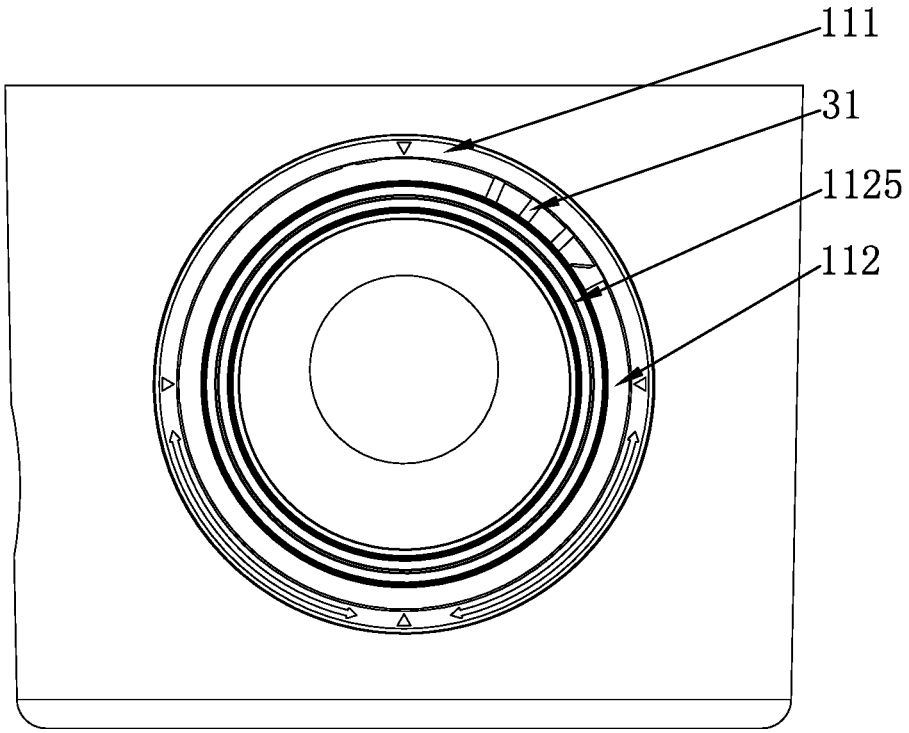
FIG. 7 is a first modification of the plug housing of the rotatable electric plug according to the preferred embodiment of the present invention.
Figure 8:
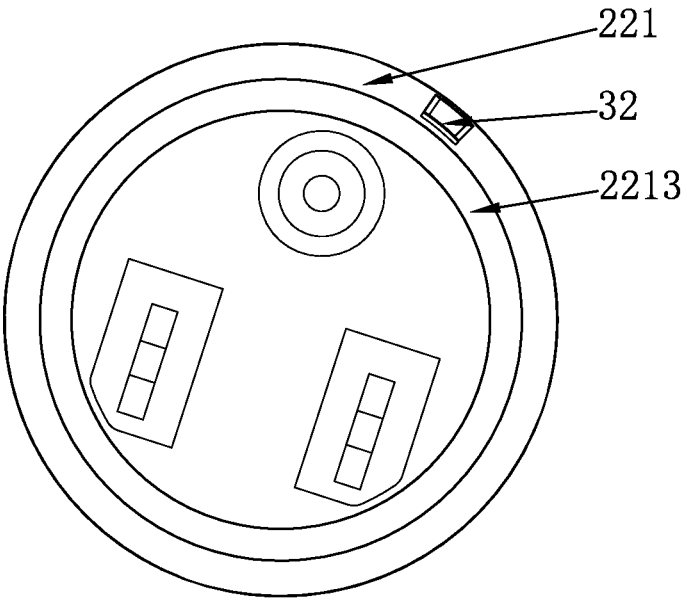
FIG. 8 is the first modification of the plug module of the rotatable electric plug according to the preferred embodiment of the present invention.

As shown in FIG. 7 to FIG. 8 of the drawings, a first modification is illustrated for the above preferred embodiment, in which the first modification of the rotatable electric plug contains all the structural components in the above embodiment. Specifically, the extension casing 11 may further have a second sliding groove 1125 coaxially formed at the blocking rim 112, wherein the second sliding groove 1125 may have a circular configuration. The mounting body 22 may further comprise a protrusion member 2213 protruded from the first side 221 thereof, wherein the protrusion member 2213 may extend corresponding to the second sliding groove 1125. When the mounting body 22 is coupled at the extension casing 11, the protrusion member 2213 may slidably engage with the second sliding groove 1125, such that the protrusion member 2213 is guided to slide along the second sliding groove 1125 when the mounting body 22 is rotated. In other words, the sliding engagement between the protrusion member 2213 and the second sliding groove 1125 will ensure and guide the rotatable route of the mounting body 22 and will enhance the smooth rotational movement of the plug module 20.

The protrusion member 2213 may be formed in a circular ring structure corresponding to the second sliding groove 1125. Alternatively, the protrusion member 2213 may be constructed to have a plurality of arc-shaped protruding portions uniformly distributed along the circumferential portion of the first side 221 of the mounting body 22. The uniform distribution of the arc-shaped protruding portions of the protrusion member 2213 may be able to enhance the smooth and stable rotational movement of the mounting body 22. In the first modification of the present invention, the protrusion member 2213 may preferably be formed in a circular ring structure corresponding to the second sliding slot 1125.

As shown in FIG. 7 of the drawings, the limiting assembly 30 may comprise one or more first limiting members 31 outwardly extended from the circumferential portion of the blocking rim 112, wherein the first limiting member 31 may have a first engaging portion. Two or more of the first limiting members 31 may serve as a plurality of limiting blocks, wherein the first limiting members 31 may be positioned adjacent to each other to enhance the position limiting function. However, it should not be limited, and the limiting member can also be configured as a block or other position limiting structure. Preferably one first limiting member 31 may be provided and disposed between the inner wall of the sleeve body 111 of the plug housing 10 and the second sliding slot 1125. However, the location of the first limiting member 31 should not be limiting. For example, the first limiting member 31 may extend from the blocking rim 112 at an area where the second sliding groove 1125 is not extended therefrom, and is disposed between the coupling member 2211 and the inner wall of the sleeve body 111 without blocking the rotational movement of the plug module 20 at the plug housing 10. The first limiting member 31 may have a first engaging portion extended circumferentially to form a third blocking member able to be engaged with other corresponding structures.

As shown in FIG. 8 of the drawings, the limiting component 30 may further comprise a second limiting member 32 formed on the first side 221 of the mounting body 22, wherein the second limiting portion 32 may have a second engaging portion. Accordingly, the second limiting member 32 may be formed on the first side 221 of the mounting body 22 outside the protrusion member 2213. The first engaging portion of the first limiting member 31 may engage with the second engaging portion of the second limiting member 32 to block the further rotational movement of the plug module 20 so as to prevent the plug module 20 being rotated infinitely at the plug housing 10. The second limiting member 32 may be formed on the first side 221 of the mounting body 22, wherein the plug module 20 may be mounted at the plug housing 10.

The second limiting member 32 may be located corresponding to the position of the first limiting member 31. The second limiting member 32 may have a second engaging portion extended circumferentially to form a fourth blocking member to contact with the third blocking member so as to enable the snap connection between the first engaging portion of the first limiting member 31 and the second engaging portion of the second limiting member 32. When the plug module 20 is rotated in one direction within the plug housing 10 at a certain angular angle, the first limiting member 31 may be in contact with the second limiting member 32 in order to engage the first engaging portion with the second locking portion so as to block the further rotational movement of the plug module 20. Therefore, the engagement between the first limiting member 31 and the second limiting member 32 may limit the angular displacement of the plug module 20 and prevent the infinity rotational movement of the plug module 20. If the direction of the protruding pin 21 is needed to change, the plug module 20 or the plug housing 10 can be rotated in an opposed direction. Therefore, the rotation of the plug module 20 will prevent any wire damage of the connection wire unit, and thus enhance the rotational movement of the plug module 20.

The first limiting member 31 may have a first limiting surface defined as the first engaging portion and an opposed second limiting surface as the first blocking portion. The second limiting member 32 may have a third limiting surface defined as the second engaging portion and an opposed fourth limiting surface defined as the second blocking portion. Accordingly, when the mounting body 22 is rotated in one direction until the third limiting surface is contacted with the first limiting surface, the plug module 20 may be blocked to further rotate in one direction. When the mounting body 22 is reversibly rotated in an opposite direction until the fourth limiting surface is contacted with the second limiting surface, the plug module 20 may be blocked to further rotate in the opposite direction. The first limiting surface of the first limiting member 31 and the third limiting surface of the second limiting member 32 may be configured as two flat surfaces while the second limiting surface of the first limiting member 31 and the fourth limiting surface of the second limiting member 32 may be configured as two inclined surfaces. Therefore, the first limiting member 31 and the second limiting member 32 may form a trapezoidal shape.

Figure 9:
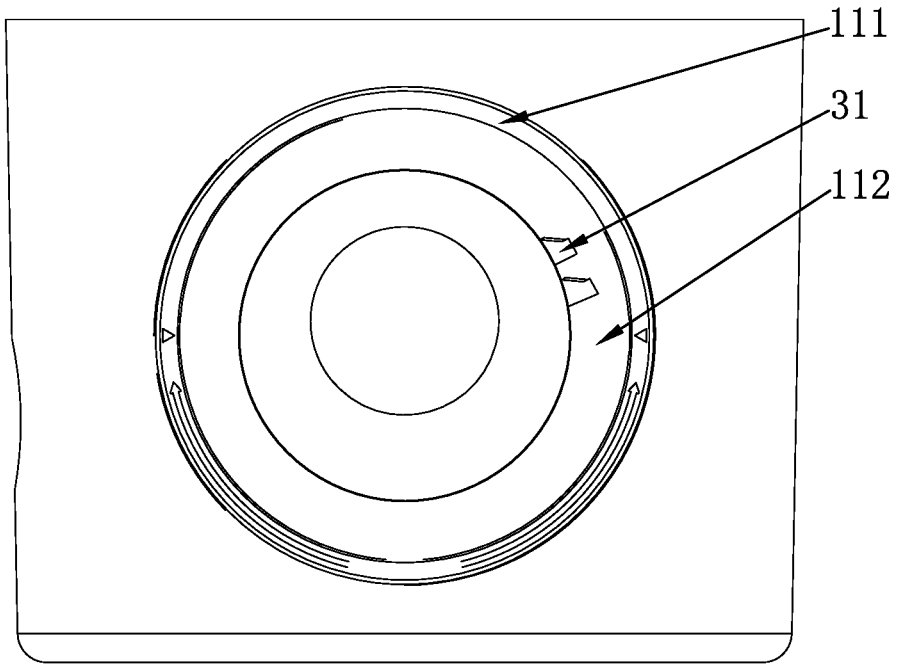
FIG. 9 is a second modification of the plug housing of the rotatable electric plug according to the preferred embodiment of the present invention.

As shown in FIG. 9 of the drawings, a second modification is illustrated for the above embodiment, wherein the second modification of the rotatable electric plug contains all the structural components in the above embodiment. Specifically, the extension casing 11 may further comprise a third sliding groove 1111 coaxially formed at the inner wall of the sleeve body 111, wherein a peripheral edge of the mounting body 22 may slidably engage with the third sliding groove 1111 to guide the rotational movement of the plug module 20. The first side 221 of the mounting body 22 may not contact the surface of the blocking rim 112 during the rotation of the plug module 20 at the plug housing 10.

As shown in FIG. 9 of the drawings, the limiting assembly 30 may be connected to the plug housing 10 and the plug module 20. The limiting assembly 30 may comprise a first limiting member 31 circumferentially distributed on the blocking rim 112 at a position that the first limiting member 31 is located within the third sliding groove 1111. The first limiting member 31 may have a first engaging portion. The first limiting member 31 may be disposed between the inner wall of the sleeve body 111 and an opening of the blocking rim 112 without blocking the rotational movement of the plug module 20 at the plug housing 10. The first limiting member 31 may have a first engaging portion extended circumferentially for engaging with other engaging members.

The limiting component 30 may further comprise a second limiting member 32 disposed on the first side 221 of the mounting body 22, wherein the plug module 20 may be mounted on the plug housing 10. The second limiting member 32 may be disposed corresponding to the position of the first limiting member 31 at the plug housing 10. When the plug module 20 is rotated at the plug housing 10 at a certain angular angle, the second limiting member 32 may be in contact with the first limiting member 31 in response to the relative positions of the first limiting member 31 and the second limiting member 32.

The second limiting member 32 may have a second engaging portion extended circumferentially, wherein the first engaging portion of the first limiting member 31 and the second engaging portion of the second limiting member 32 may be engaged to block the further rotational movement of the plug module 20 at the plug housing 10. Therefore, the engagement between the first limiting member 31 and the second limiting member 32 will limit the angular displacement of the plug module 20 and prevent the infinity rotational movement of the plug module 20.

Preferably, the first limiting member 31 has a first limiting surface may be defined as the first engaging portion and an opposed second limiting surface as the first blocking portion. The second limiting member 32 may have a third limiting surface defined as the second engaging portion and an opposed fourth limiting surface defined as the second blocking portion. Accordingly, when the mounting body 22 is rotated in one direction until the third limiting surface is contacted with the first limiting surface, the plug module 20 may be blocked to further rotate in one direction. When the mounting body 22 is reversibly rotated in an opposite direction until the fourth limiting surface contacts with the second limiting surface, the plug module 20 may be blocked to further rotate in the opposite direction. Preferably, the first limiting surface of the first limiting member 31 and the third limiting surface of the second limiting member 32 may be configured as two flat surfaces while the second limiting surface of the first limiting member 31 and the fourth limiting surface of the second limiting member 32 may be configured as two inclined surfaces. Therefore, the first limiting member 31 and the second limiting member 32 may form a trapezoidal shape.

The present invention, while illustrated and described in terms of a preferred embodiment and several alternatives, is not limited to the particular description contained in this specification. Additional alternative or equivalent components could also be used to practice the present invention.

What is claimed is:

1. A rotatable electric plug, comprising:

a plug housing which comprises a sleeve body having a hollow structure, a blocking rim inwardly extended from an inner wall of said sleeve body, and two or more guiding protrusions;

a plug module which comprises a mounting body rotatably coupled in said sleeve body that a rotational movement of said mounting body is reversible, and at least a protruding pin extended from said mounting body, wherein said mounting body has a first side and an opposed second side that a portion of said protruding pin is extended from said first side of said mounting body, said mounting body engaging with said blocking rim to prevent said mounting body detaching from said sleeve body while said mounting body is rotatably coupled at said sleeve body, said guiding protrusions spacedly extending from said blocking rim to contact with said first side of said mounting body for ensuring the rotational movement of said mounting body in a stable and balancing manner; and a limiting assembly coupled to said sleeve body and said mounting body to block said plug module from rotating infinitely at said plug housing in one direction.

2. The A rotatable electric plug, comprising:

a plug housing which comprises a sleeve body having a hollow structure, a blocking rim inwardly extended from an inner wall of said sleeve body, a sliding blocker, and two or more guiding protrusions;

a plug module which comprises a mounting body rotatably coupled in said sleeve body that a rotational movement of said mounting body is reversible, and at least a protruding pin extended from said mounting body, wherein said mounting body has a first side and an opposed second side that a portion of said protruding pin is extended from said first side of said mounting body, said mounting body engaging with said blocking rim to prevent said mounting body detaching from said sleeve body while said mounting body is rotatably coupled at said sleeve body, said mounting body further comprising at least a coupling member extended from said first side of said mounting body, wherein said coupling member has a latch free end extended to engage with a back side of said blocking rim to rotatably couple said mounting body at said sleeve body; and a limiting assembly coupled to said sleeve body and said mounting body to block said plug module from rotating infinitely at said plug housing in one direction;

said plug housing further comprising a receiving groove formed at said blocking rim and a ball bearing element rotatably received at said receiving groove to bias against said first side of said mounting body so as to enhance said rotational movement of said mounting body;

said mounting body further having a plurality of first sliding grooves spacedly formed at said first side of said mounting body in such a manner that said first sliding grooves are radially indented on said first side of said mounting body and extend to a peripheral edge of said mounting body, said ball bearing element being rotatably slid at said first side of said mounting body from one of said first sliding grooves to another said sliding groove to rotate said mounting body at said sleeve body, said ball bearing element being slid to engage with one of said first sliding grooves to retain an angular angle of said mounting body;

said sliding blocker being provided at said blocking rim and extended to slidably contact with said first side of said mounting body, such that when said ball bearing element is slid at said first side of said mounting body, said sliding blocker is correspondingly slid at said first side of said mounting body, and when said ball bearing element is engaged with one of said first sliding grooves, said sliding blocker is engaged with another said sliding groove to stop said rotational movement of said mounting body;

said two or more guiding protrusions spacedly extending from said blocking rim to contact with said first side of said mounting body for ensuring the rotational movement of said mounting body in a stable and balancing manner.

* * * * *